US005940888A

United States Patent [19]

Sher

[11] Patent Number: 5,940,888

[45] Date of Patent: Aug. 24, 1999

[54] LYMPHATIC CIRCULATION ENHANCER

[76] Inventor: Jayson I. Sher, 11775 Bellagio Rd., Los Angeles, Calif. 90049

[21] Appl. No.: 08/852,385

[22] Filed: May 7, 1997

[51] Int. Cl.[6] ..... A41C 3/00

[52] U.S. Cl. ..... 2/267; 2/54; 2/109; 450/1; 450/38

[58] Field of Search ..... 2/267, 53, 54, 2/463, 465, 105, 106, 109, 110; 450/89, 1, 54, 57, 38, 41, 7; 601/151, 152; 604/204, 201; 128/874

[56] References Cited

U.S. PATENT DOCUMENTS

| | | | |
|---|---|---|---|
| 632,883 | 9/1899 | Squires | 2/53 |
| 1,765,725 | 6/1930 | Imbach | 2/53 |
| 1,982,649 | 12/1934 | Dugan | 2/53 |
| 2,503,847 | 4/1950 | Shanahan | 450/89 |
| 2,556,231 | 6/1951 | Stephens | 2/53 |
| 2,573,346 | 10/1951 | Madsen | 2/53 |
| 2,911,647 | 11/1959 | Dixon et al. | 2/53 |
| 5,007,111 | 4/1991 | Adams | 2/910 |
| 5,800,245 | 9/1998 | Barbe-Vicuna et al. | 450/1 |

FOREIGN PATENT DOCUMENTS

| | | | |
|---|---|---|---|
| 662921 | 5/1965 | Belgium | 450/89 |

*Primary Examiner*—Amy B. Vanatta
*Attorney, Agent, or Firm*—Sanford Astor

[57] ABSTRACT

This invention comprises a rigid, semi-rigid or flexible membrane upon which are located a plurality of raised projections or protuberances in a variety of possible geometric shapes. The membrane also has a plurality of vents or cut-outs which give stress relief for the membrane and act as air vents to provide ventilation for the comfort of the wearer. The device is adapted to be placed under the side panels of a woman's brassiere to aid lymphatic flow of the breast tissue lymphatic system by performing a massaging action and removing constriction on the axillary lymphatic vessels.

10 Claims, 6 Drawing Sheets

LYMPHATIC CIRCULATION ENHANCER

BACKGROUND OF THE INVENTION

The body's lymphatic system has two functions, to drain lymph fluid formed in the peripheral tissues and to manufacture lymphocytes which are involved in the body's defensive process. Lymph is the clear fluid that bathes the cells. The interstitial fluid contains cell debris, nutrients, waste products, fats, proteins, sugars, hormones, and other substances, including toxins. This interstitial space is the micro environment of cells. Clearly it is important for this space to drain freely so that it is cleaned of debris, waste and toxins. If the interstitial space were kept stagnant, the cells would die, starved of oxygen and nutrients and poisoned by their own toxic waste, as well as by environmental toxins that enter the body through food, water and air contamination.

Drainage of body tissue occurs with the help of the bloodstream and the lymphatics. New fluid, filled with nutrients and oxygen, seeps through capillary walls into the interstitial space. Some fluid returns through the capillaries into the veins, but a significant amount of fluid, as well as white blood cells, proteins, fats, some toxins and large particles of debris are left behind, constituting lymph, which must find another way back into the bloodstream. The lymph collects in small, blindly ending vessels called lymphatics, which are found throughout the body. Lymph vessels are not unlike veins, as both are lined with a large number of one-way valves that keep the blood and lymph moving in the proper direction. Unlike veins, lymphatics get no help from the blood pressure caused by the heart, but rely primarily on the movement of muscles that massage the outside of the vessels and surrounding tissue to maintain flow. In addition, axillary flow is aided by the movement of respiration which pushes or pulls the lymph along each time a person inhales. Because lymphatic vessels are very thin, they are extremely sensitive to pressure and are easily compressed. If the compression is rhythmical, like that created by natural movements or massage, lymph will flow. If the compression is constant and/or constrictive, the vessel will collapse and remain closed, hampering the flow.

In a woman's breast, which is an accessory skin gland, the lymphatics are close to the skin and therefore are especially easy to compress. The lymphatics pass through successive lymph nodes, which are specialized glands found in clusters throughout the body. One of the largest cluster of lymph nodes is in the armpit, where twenty to thirty nodes reside deep within the underarm and the upper chest regions. These clusters collect and filter lymph from the breasts, as well as from the arm and upper part of the chest wall.

Because the lymph nodes filter out unwanted matter drained from the tissues by the lymphatics, they are central to the prevention of disease. In addition, the lymph nodes are the site of much white blood cell and antibody manufacture. These cells are key players in a body's immune system. When the lymph nodes detect foreign objects such as bacteria, toxins, or even cancer cells, they activate the synthesis of the immune system. Sometimes this process causes the lymph nodes to swell painfully, as well can be the case with sore throats and cysts (which in breast tissues are mostly swollen lymph nodes). Tissue that is drained constantly will be cleansed of these toxins, whereas tissue that is congested and sluggishly drained may keep its toxin reservoir for long periods of time, concentrating the exposure. Over the years, this may result in tissues having a relatively high toxin exposure, compared with the freely draining tissue. Over 85% of the lymph fluid flowing form the breasts drains to the armpit, or axillary lymph nodes, If anything were to constrict the flow of lymph from the breast, there would be poor drainage of the breast tissue. Due to the active fluid pressure from the heart, it takes a large amount of pressure to affect the blood vascular system but it does not take much force to affect the flow of the lymph vessels. Slight pressure, such as soft tissue compression, can negatively influence flow within the vessels.

Considering the manner in which a woman's bra is constructed and the lymphatic drainage described above, it appears to be clear that armpit lymph nodes and the lymphtics leading to them are constricted by a bra. It is also well known that there is an increased danger due to exposure to toxins in our environment. These toxins enter all the tissues of the body and are drained by the lymphatic system. The lymph nodes filter the lymph fluid of contaminants and the liver helps process the toxins for disposal from the body. Constriction of the lymph system by a woman's bra prevents normal drainage of the lymph fluid, keeping toxins concentrated within the breast tissue for a much longer period of time, where the toxins can do damage including transforming normal cells into mutated cells.

Thus, the immune system of the breast, being hampered by the bra, is unable to drain the tissue, filter out toxins and repair damage.

GENERAL DESCRIPTION OF THE INVENTION

The lymphatic circulation enhancer of this invention is designed to increase the lymphatic circulation in the area of the breasts and comprises a flat membrane or panel having a plurality of raised projections or protuberances fixedly attached to the membrane, or molded with the membrane as one complete item. The membrane can be rigid, semi-rigid or flexible and contains a pluality of vents or cut out openings therein for flexibility ventilation and comfort.

The enhancer is designed to be placed under the bra's side panels, either directly or into protective sleeves or pockets in the side panels, or can be constructed into the side panels at the time the bra is manufactured. The membranes with the raised protuberances is designed to aid the breast tissues lymphatic system, increasing drainage by removing the binding and constrictive pressure on the axillary lymphatic vessels and tissues, while peforming a massaging action with respiration and normal movements, also adding comfort to the bra wearer.

OBJECTS OF THE INVENTION

Accordingly, several objects and advantages of the invention are as follows:

It is an object of the present invention to provide a device to enhance the lymphatic flow in the area of the breast.

It is a further object of the invention to provide a device which can be utilized with any existing bra or manufactured into new bras.

It is yet a further object of the invention to provide a device which makes a bra more comfortable to wear, along with increasing axillary lymphatic circulation.

These and other objects of the invention will be obvious from the following detailed desciption in reference to the following drawings.

DETAILED DESCRIPTION OF THE INVENTION

Figure 1:
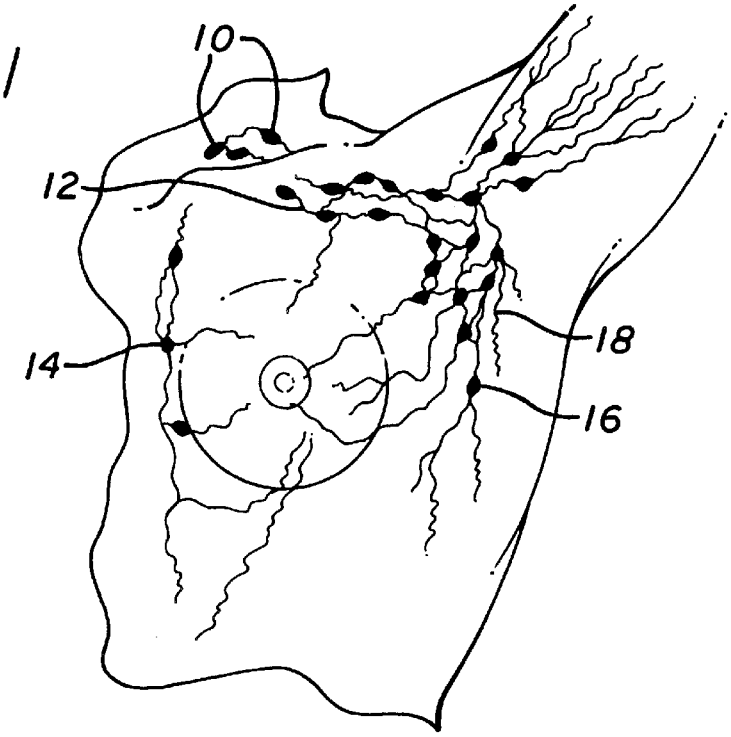
FIG. 1 is a representation of the lymphatic system.

Referring now to the drawings there is shown in FIG. 1 a representation of the schema of the lymphatic drainage in the area of the underarm and breast of a woman. There can be seen the superclavicular lymph nodes 10, the apical axillary nodes 12, the parasternal nodes 14, and the pectoral axillary nodes 16. The lymphatics 18 are the drainage system for the lymph system as explained in the background of the invention.

Figure 2:
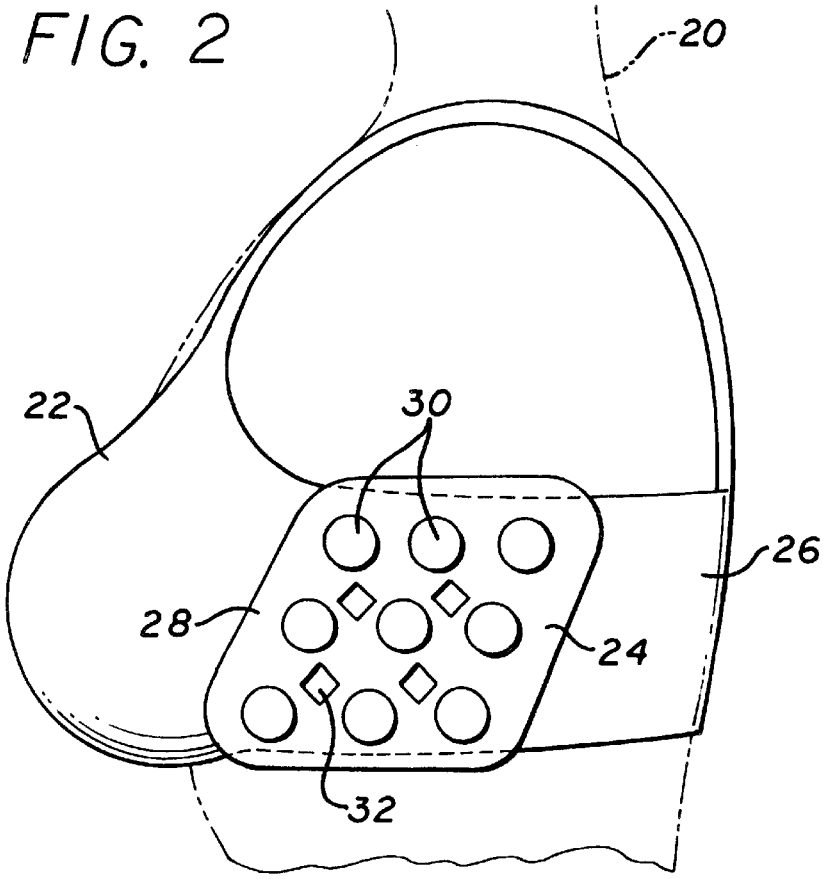
FIG. 2 is a side view showing the use of the lymphatic enhancer of the present invention.

Referring to FIG. 2 there is shown a woman 20 wearing a bra 22 which has lymphatic circulation enhancer 24 placed underneath the side panel 26 of bra 22. Enhancer 24 comprises a support base material or membrane 28 having a plurality of raised projections or protuberances 30 projecting towards the body 20 underneath bra 24.

Figure 3:
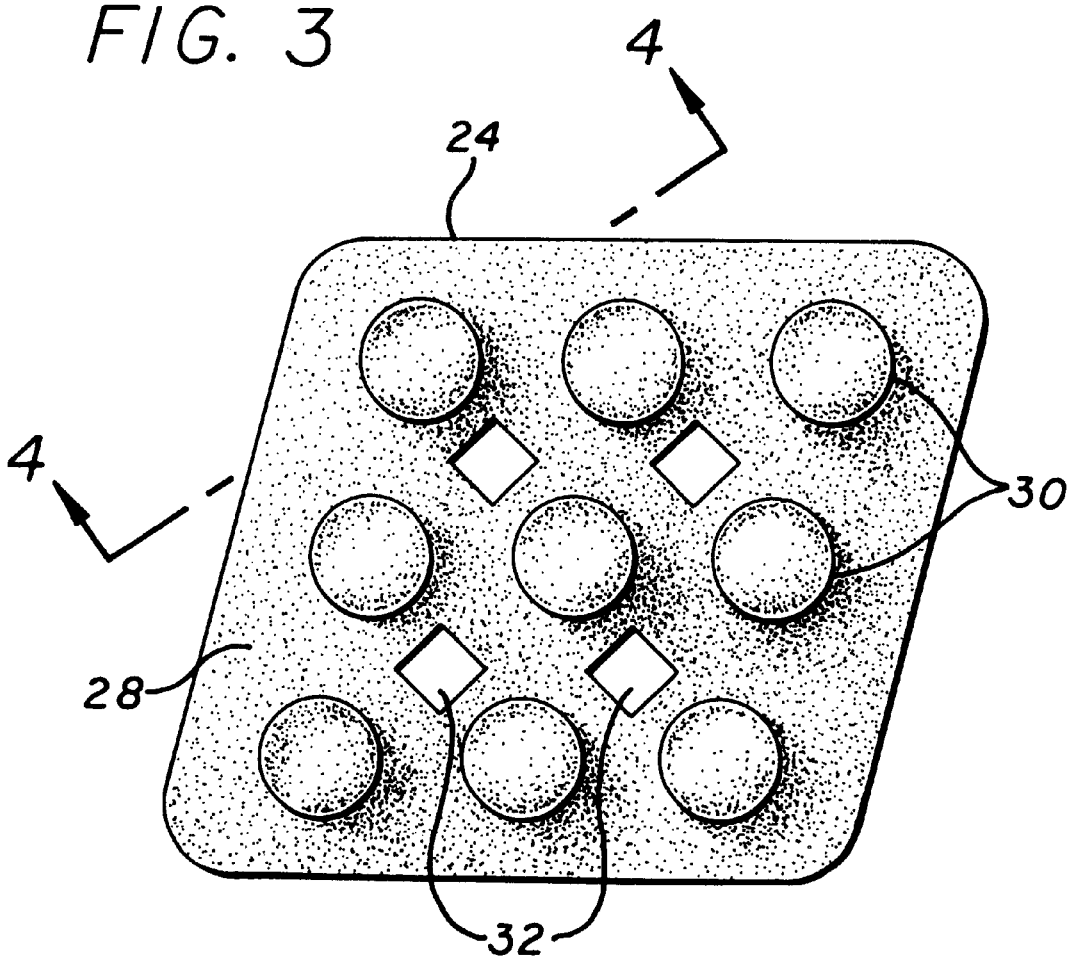
FIG. 3 is a top view thereof.

As shown more clearly in FIG. 3 enhancer 24 comprises a plurality of raised geometric shapes or protuberances 30 fixedly attached to membrane 28. Protuberances 30 can be mounted onto, membrane 28 by any convenient method such as being bonded, glued, sewn, adhered, or laminated. Protuberances 30 can also be manufactured, molded, formed or cast as a part of membrane 28.

Protuberances 30 can be of any size and shape and can be constructed of foam, plastic, nylon, rubber, or any other inert material. They can be solid, or gel, fluid or gas filled.

A plurality of vents or cut-outs 32 are provided for ventilation for the skin for the comfort of the wearer. Cut-outs 32 also make membrane 28 more flexible and more easily shaped to the body for more comfort in wearing. Protuberances 30 and vents 32 act in a manner to provide interspersed raised projections pressed against the skin, allowing membrane 28 to suspend bra side panel 26 away from the skin, allowing sufficient axial lymphatic circulation between projections 30 even though pressure is placed directly upon membrane 28 and raised projections 30 by bra side panels 26. The number, shape and size of protuberances 30 and membrane 28 will be determined by the size and shape of the woman's breast and bra configuration. The heat from the body aids in making the enhancer more flexible which allows it to conform more readily to the shape of the body for comfort.

Figure 4:
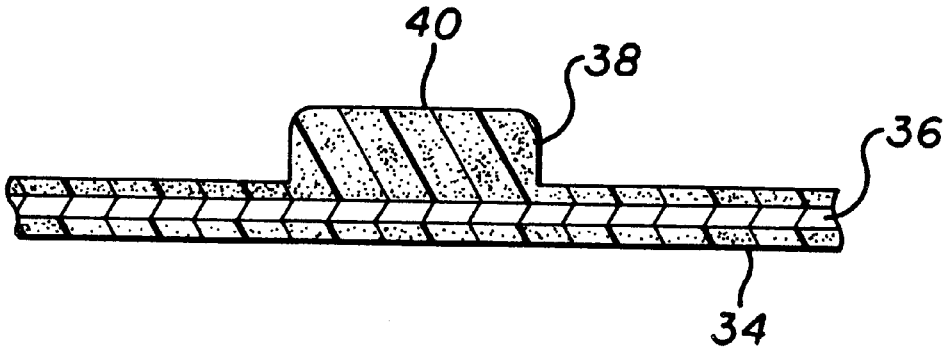
FIG. 4 is a cross-sectional view taken on lines 4—4 of FIG. 3.

FIG. 4, which is a cross-section taken on lines 4—4 of FIG. 3, shows enhancer 24 with a backing 34, membrane 36 and a top layer 38 made of a material such as compressed foam. Protuberance 40 is formed as a part of top layer 38 which completely covers membrane 36.

Figure 5:
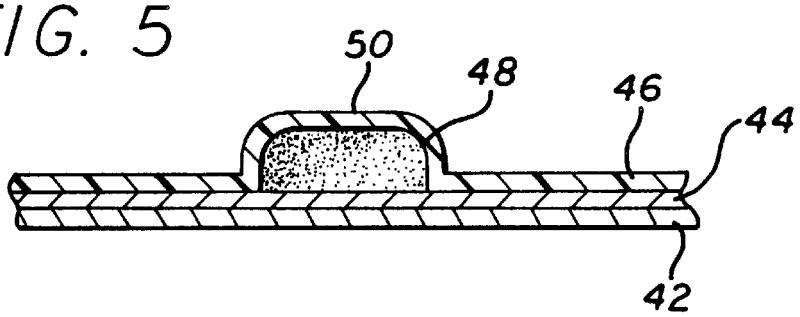
FIG. 5 is a cross-sectional view of another embodiment of the invention.

Another embodiment is shown in FIG. 5 which has backing 42, membrane 44, and an inert flexible skin 46 covering membrane 44. Protuberance 50 is formed by a solid, gel, gas or fluid filling 48.

Figure 6:
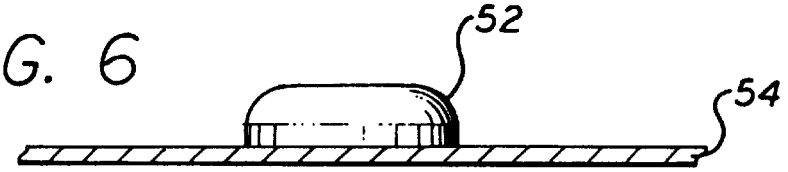
FIG. 6 is a cross-sectional view of another embodiment.

FIG. 6 is another embodiment in which there is a solid foam or rubber protuberance 52 fixedly attached directly to membrane 54, which may or may not have a backing.

Figure 7:
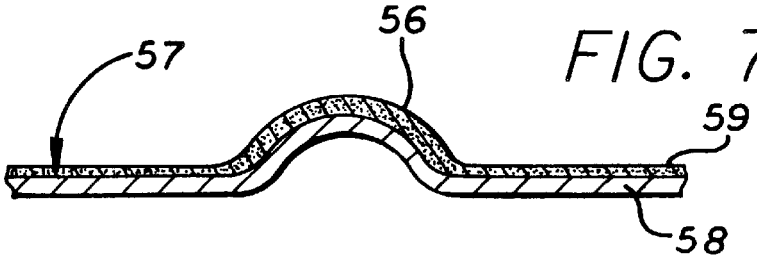
FIG. 7 is a cross-sectional view of another embodiment.

FIG. 7 shows the protuberance 56 molded or cast as a top layer 57 affixed to membrane 58 which can all be molded and affixed in a one-step process. The top layer 57 is pressed to a thin layer 59 between protuberances 56, which gives a greater height to protuberances 56 from the surface 57. This may or may not have a backing or covering as desired.

Figure 8:
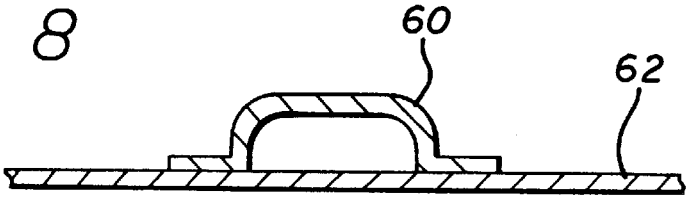
FIG. 8 is a cross-sectional view of another embodiment.

FIG. 8 shows an individual protuberance 60 separately molded and attached to membrane 62, again with or without backing.

Figure 9:
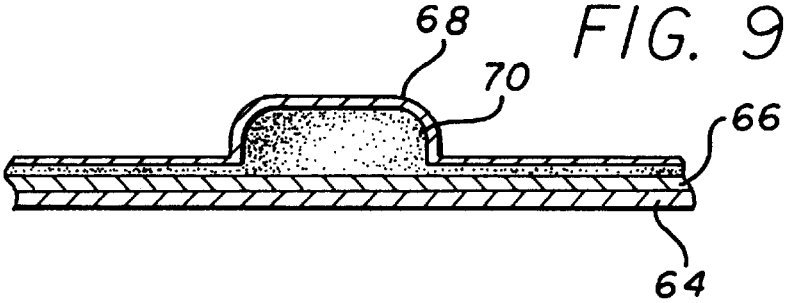
FIG. 9 is a cross-sectional view of another embodiment.

FIG. 9 is another embodiment which shows a backing 64 a membrane layer 66, and a fluid, gel or gas filling 70 under an outer flexible skin 68. The filling 70 comprises a layer which covers the entire top surface of membrane 66.

All of these embodiments may be used with or without the backing as desired and, while only one protuberance is shown for sake of example, each embodiment of the enhancer has a plurality of protuberances as shown in FIG. 3 and a plurality of vents or cut-outs for ventilation, comfort and flexibility.

Figure 10:
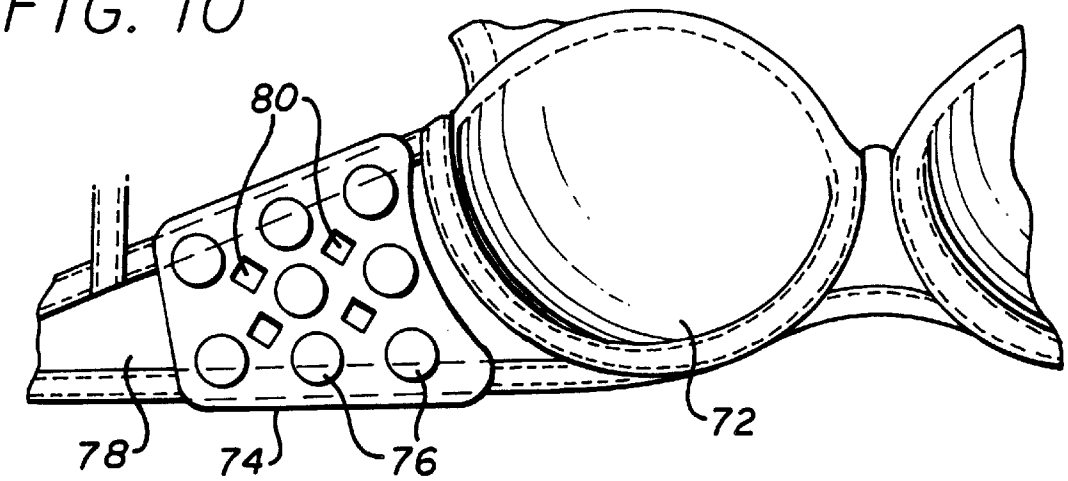
FIG. 10 is a front view of the device in a bra.

FIG. 10 shows a woman's bra 72 in which lymph flow enhancer 74 is built into, or manufactured as a part of, bra 72. Bra 72 is shown inside-out in order to show protuberances 76, which face the skin under bra side panels 78. A plurality of vents or cut-outs 80 are provided for ventilation and comfort.

Figure 11:
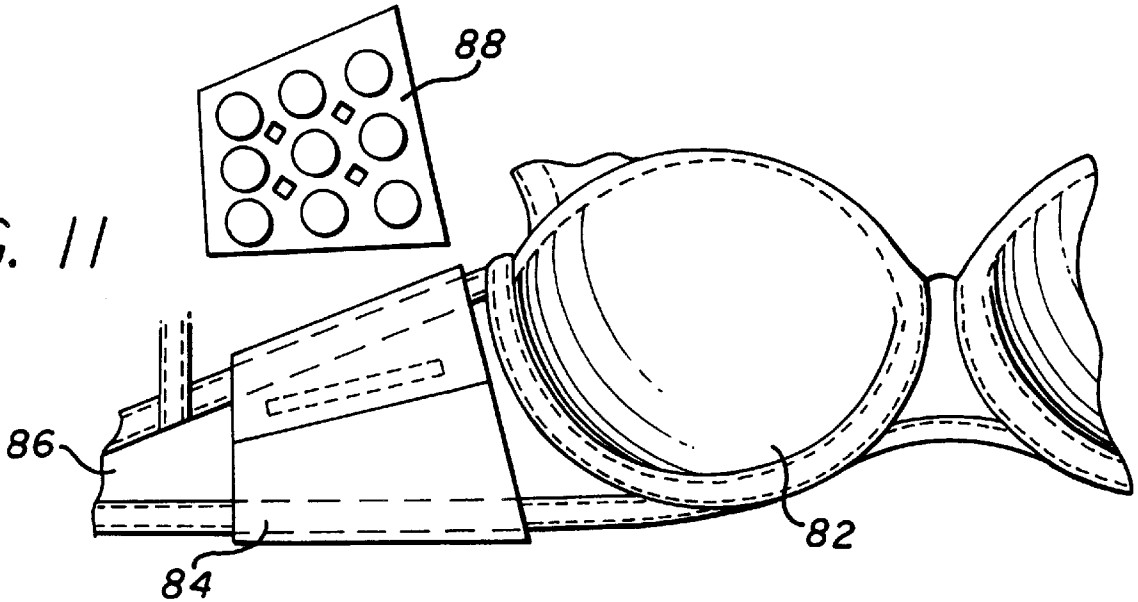
FIG. 11 is a front view of the device in a sleeve in a bra.

FIG. 11 shows another embodiment in which the bra 82 has a jacket or sleeve 84 which fits over side panel 86 to hold enhancer 88 in place. Jacket or sleeve 84 is adjustably closed around side panel 86 by a hook and loop fastener, such as VELCRO, snaps or other fastening means. In practice, however, due to the tightness of the side panels of a normal bra against the body, the enhancer may be placed inside a side panel of a bra, without anything to hold it in place, and it will be held firmly in place without slippage.

Figure 12:
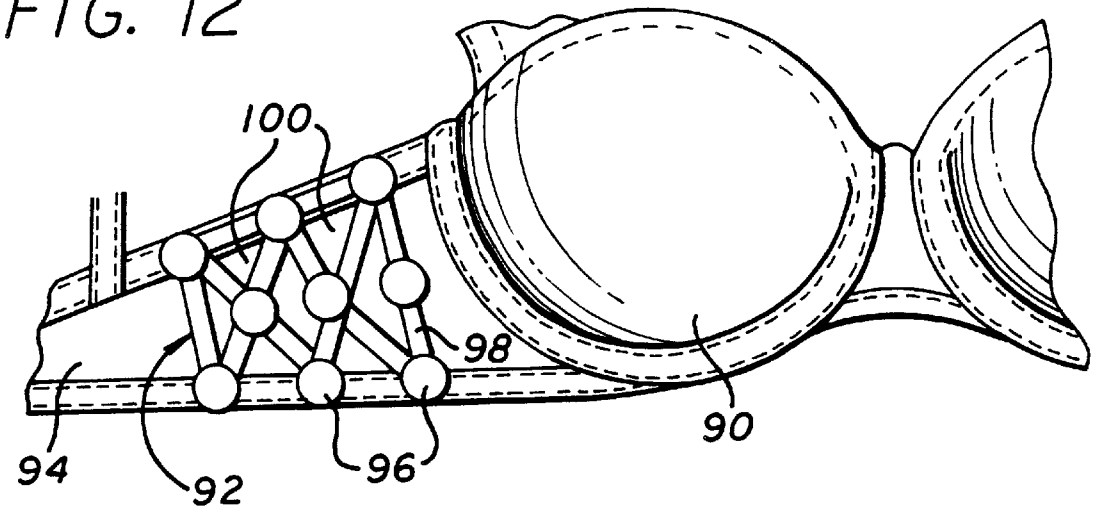
FIG. 12 is a front view of another embodiment in a bra.

FIG. 12 shows another embodiment with enhancer 92 built into bra 90 at bra side panel 94. In this embodiment, protuberances 96 are placed on membrane 98 which is cut into a ribbed lattice pattern making cut-outs 100 much larger. This makes enhancer 92 more flexible because there is less base material in membrane 98.

Figure 13:
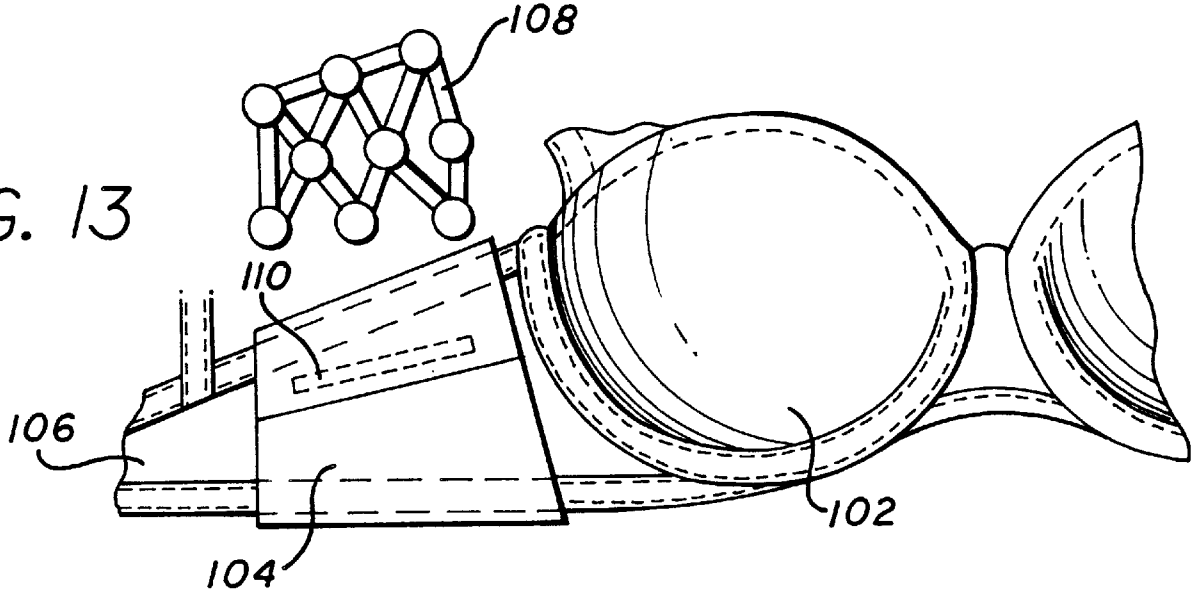
FIG. 13 is a front view of another embodiment.

FIG. 13 shows another embodiment with bra 102 and a sleeve 104 built into bra side panel 106. Enhancer 108 fits into pocket or sleeve 110. Enhancer 108 is of the same lattice type shown in FIG. 12.

Figure 14:
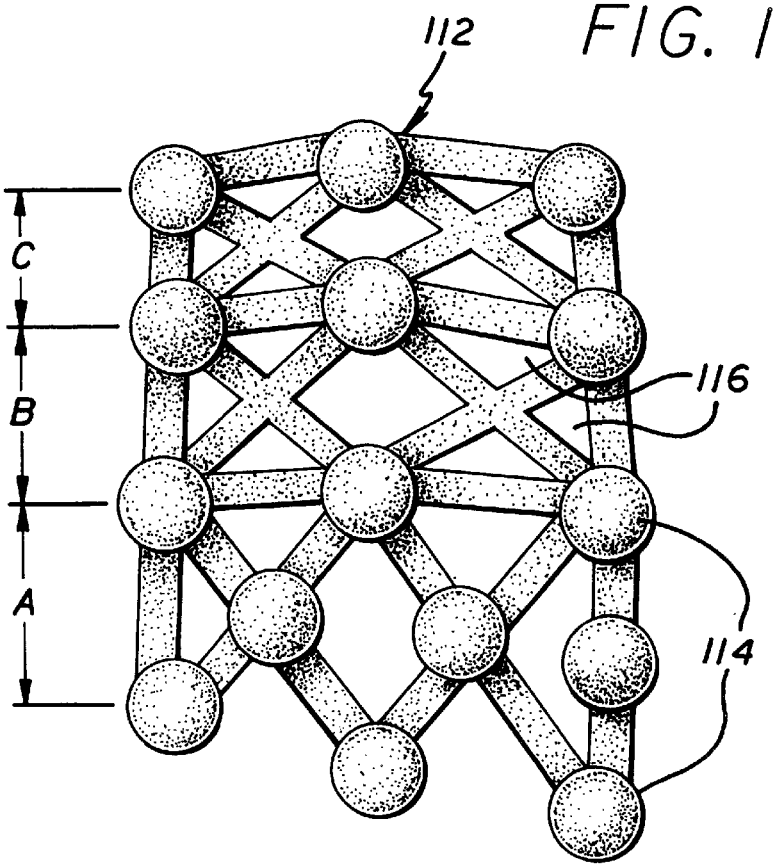
FIG. 14 is a top view of another embodiment.
Figure 15:
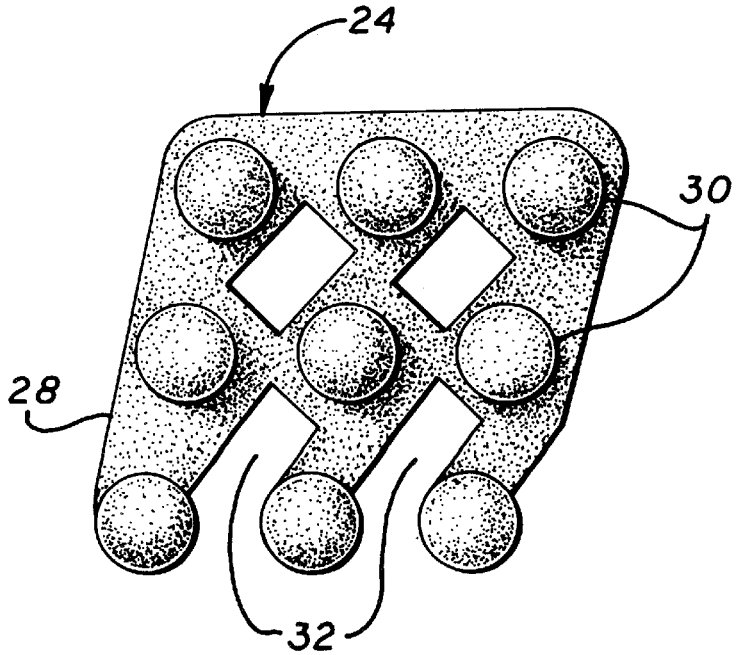
FIG. 15 is a top view of another embodiment.

FIG. 14 shows enhancer 112 with protuberances 114 and cutouts or vents 116. This embodiment shows how enhancer 112 can be made in three sizes where it is the large size as shown. Section "C" can be cut off to provide a medium size and Section "B" can also be cut off, leaving only Section "A" as the small size. FIG. 15 is an embodiment similar to FIG. 3 with the lower portion cut away to provide more flexibility, if desired.

The enhancer as described, will eliminate the constant binding and constrictive pressure on the tissues in the region, enhancing axillary lymphatic drainage while affording a massaging action, brought about by respiration and movement of the wearer, to the axillary area adjacent to the breast tissue which promotes lymphatic drainage, reabsorption and detoxification.

As stated above, the protuberances can be of any geometric shape interspersed on a membrane and act in such a way that they provide spaced raised projections causing the membrane and side panels of the bra to be kept suspended above the skin and away from the body, producing a channel type configuration throughout the device. This allows lymphatic drainage to take place between the raised projections and back into the lymphatic system even though pressure is placed directly upon the membrane and protuberances from the binding and constrictive effect of the bra side panels.

Having thus described the invention,

I claim:

1. A lymphatic circulation enhancer adapted to be worn under the side panels of woman's brassiere comprising a lattice framework having a plurality of raised protuberances projecting outward therefrom, means to attach the lattice framework to the brassiere with the protuberances facing towards the body of a woman wearing the brassiere.

2. The enhancer of claim 1 in which the raised protuberances are part of a top layer which extends across the entire top surface of the lattice framework.

3. The enhancer of claim 1 in which the raised protuberances are filled with a fluid, gel or gas.

4. The enhancer of claim 1 further comprising a layer of fluid, gel or gas interposed between the lattice framework and a top layer.

5. The enhancer of claim 1 in which the raised protuberances are individually fixedly attached to the lattice framework.

6. The enhancer of claim 1 in which the lattice framework and a top layer covering the entire surface of the lattice framework are affixed together and the raised protuberances are formed by molding both layers together into a plurality of raised portions.

7. The enhancer of claim 1 or 2 in which the protuberances are made of foam, rubber, fabric or plastic.

8. A brassiere having left and right side panels, each side panel having an inner and outer surface, a plurality of raised protuberances attached to the inner surface of each of the side panels, the raised protuberances facing towards the body of a person wearing the brassiere.

9. The combination of a brassiere having left and right side panels, each side panel having an inner and outer surface, a pair of lattice frameworks having a plurality of raised protuberances thereon, each of said lattice frameworks adapted to be worn adjacent to the inner surface of each of the side panels, the raised protuberances facing towards the body of a person wearing the brassiere.

10. A method for enhancing the circulation of the lymphatic system in a woman's body adjacent to her breasts, when the woman is wearing a brassiere, said brassiere having left and right side panels with inner and outer surfaces, comprising, attaching to the inner surface of each of the side panels of the brassiere, a plurality of raised protuberances, the protuberances facing towards the body, thereby providing spaced channels for the flow of lymphatic fluid and also providing massaging of the body.

* * * * *